United States Patent [19]

Morrison et al.

[11] 4,047,014

[45] Sept. 6, 1977

[54] COORDINATE CONVERTER

[75] Inventors: Steven Morrison, Baltimore; George A. Williams, Ellicott City, both of Md.

[73] Assignee: Westinghouse Electric Corporation, Pittsburgh, Pa.

[21] Appl. No.: 672,893

[22] Filed: Apr. 2, 1976

[51] Int. Cl.[2] ..... G06G 7/22; G06G 7/80

[52] U.S. Cl. ..... 235/189; 89/41 EA; 235/61.5 S; 235/61.5 E

[58] Field of Search ..... 235/197, 186, 189, 150.25, 235/150.35, 150.27, 61.5 R, 61.5 E, 61.5 G, 61.5 S, 61.5 T; 89/37.5 C, 41 E, 41 EA, 41 CE, 1.5 S, 1.5 E; 340/347 SY; 244/14; 331/53, 76; 328/16, 17, 18; 33/229, 230, 233, 234, 235, 236

[56] References Cited

U.S. PATENT DOCUMENTS

| | | | |
|---|---|---|---|
| 2,995,302 | 8/1961 | Ingwerson et al. | 235/189 X |
| 3,371,199 | 2/1968 | Schwartzenberg et al. | 235/189 |
| 3,415,157 | 12/1968 | Marchisio et al. | 89/41 E |
| 3,803,387 | 4/1974 | Lackowski | 235/61.5 S X |
| 3,829,659 | 8/1974 | Margolis | 235/61.5 S |

*Primary Examiner*—Joseph F. Ruggiero
*Attorney, Agent, or Firm*—R. M. Trepp

[57] ABSTRACT

An electronically controlled coordinate converter for transforming vectors from a first coordinate system to a second coordinate system through an input angle is provided using a harmonic oscillator which is responsive to an oscillation angle control signal having a discontinuity or transition point wherein an incremental change in the input angle at a predetermined value causes a step function in the duration of said oscillation angle control signal. The discontinuity in the oscillation angle control signal is eliminated by control circuits within a selected range of input angles where the error effects due to transformations on either side of the discontinuity are avoided. Another feature of the invention is that the discontinuity in the oscillation angle control signal may be shifted away from or in response to a previous vector transformation having an input angle close to the discontinuity to avoid recurrent vector transformations on either side of the oscillation angle control signal discontinuity due to slight incremental fluctuations in the input angle.

11 Claims, 11 Drawing Figures

80
A COS θ
A SIN θ
BX
BY
CLOCK
FLIP FLOP
DATA
CLK
TRIGGER MULTIVIBRATOR
TRIGGER MULTIVIBRATOR
SHIFT REGISTER
DATA
CLOCK
SHIFT
FLIP FLOP
PRESET
CLEAR
ENABLE B
SDEN
LDEN
DISABP
CLEAR
PRESET
FLIP FLOP
ENABLE E
ZCTIME
EOUT
EC
-E
+E
-ER
+ER
S1
S2
S3
S4
S5

COORDINATE CONVERTER

GOVERNMENT CONTRACT

The invention herein described was made in the course of or under a contract or subcontract thereunder with the Department of the Air Force.

RELATED APPLICATION

U.S. Patent application Ser. No. 672,894, entitled "Boresight Adjustment For a Harmonic Oscillator Coordinate Converter" by S. Morrison and W. J. Dorman, filed concurrently herewith on Apr. 2, 1976 and assigned to a common assignee which relates to a harmonic oscillator coordinate converter which is directed toward a coordinate conversion of a vector through a measured angle and a boresight misalignment angle during a single angle transformation which is incorporated herein by reference.

BACKGROUND OF THE INVENTION

1. Field of the Invention

This invention relates to electronic coordinate converter apparatus, particularly to harmonic oscillator coordinate converters for transforming the coordinates of a vector from a first coordinate system to a second coordinate system.

2. Description of the Prior Art

In a moving aircraft the direction from the aircraft to the target may be continually changing due to the motion of the aircraft. If a sensor having pointing means is tracking a target, the pointing direction must be continually updated with a new pointing angle in order to keep the sensor directed at the target while the airplane is moving. In such a system, the vector R is geographic coordinates X, Y, Z, with unit magnitude is continually transformed to the sensor coordinates I, J, K so that the sensor may be continually directed at a target.

In a typical avionic system, the angle through which a vector is to be transformed is in the form of a voltage and includes some noise. The noise voltage may originate mechanically or electrically at the sensor, or it may be inductively or capacitively coupled to the signal leads at some point on its way to the electronic coordinate converter. For example, the electrical noise may be random in nature due to coupling resulting in random incremental variations or fluctuations in the angle through which the vector is to be transformed. The electronic coordinate converter using a harmonic oscillator operates over a continuous range of input angles from 0 to $2\pi$ radians or multiples thereof. However, within the harmonic oscillator, a harmonic oscillator oscillation angle is determined as a function of the input angle. The oscillation angle is an internal parameter which is used to control the harmonic oscillator when the vector R is rotated through an input coordinate angle. The oscillation angle is discontinuous or has a step function or transition point with respect to a particular input angle.

The harmonic oscillator is said to operate in one transformation mode for input angles on the left side of the oscillation angle control signal transition point and to operate in a second transformation mode for input angles on the right side of the oscillation angle control signal transition point.

The oscillation angle discontinuity occurs because the end of the oscillation angle is determined when one of the outputs of internal integrators crosses zero for the first time. The output of the internal integrator is either a cosine function or a sine function. A small increment in the input angle results in a small increment in the output of the integrator which may advance the sine or cosine function output beyond zero or may retard the sine or cosine function less than zero. In this event, the output of the integrator would cross zero either after an incremental oscillation or after an additional oscillation of slightly less than $\pi$ radius. Thus small variations in the input angle occurring in recurrent transformations may result in the oscillation angle being very small such as one milliradian and very large such as $\pi - 0.001$ radians. The abrupt change in oscillation angle such as from 0.001 to $\pi - 0.001$ may result in a slight error in the transformed vector due to the circuit components and operation. Thus, when an input angle of a vector which is continually transformed is close to the discontinuity in the oscillation angle, noise on the input angle may cause the transformation to occur on either side of the discontinuity in the oscillation angle resulting in a transformed vector with error caused by the electronic coordinate converter operating in a first and second transformation mode in addition to the noise originally on the input angle. Therefore when a sensor is directed at a target resulting in particular angular transformations across the oscillation angle transition point, the new pointing angle will have additional error due to the electronic coordinate converter operating in a first and second transformation mode. Meanwhile, for other angles on one side of the oscillation angle transition point, the new pointing angle will not have this additional source of error. The increase in error for certain angular transformations across the oscillation angle transition point due to the electronic coordinate converter operating in a first and second transformation mode is bothersome and undesirable in systems operating or tracking with high angular resolution such as 0.4 milliradians.

Thus, it is desirable to eliminate electronic coordinate converter error caused by recurrent transformations in a first and second mode (on either side of the oscillation angle discontinuity) by shifting the oscillation angle discontinuity so that recurrent vector transformations through an input angle with incremental fluctuations are performed in one transformation mode (on one side of the discontinuity).

SUMMARY OF THE INVENTION

Electronic apparatus for transforming the coordinates of at least one vector through an input angle that is a measure of rotation of a first orthogonal coordinate system relative to a second othrogonal coordinate system about a common coordinate axis is provided by a first means for generating a first signal representative of a vector, a second means for generating a second signal representative of an input angle, a third means for generating an oscillation angle control signal having a transition point or discontinuity in the duration of the oscillation angle control signal, a coordinate converter means responsive to the oscillation angle control signal for transforming the first signal in accordance with the second signal and fourth means for modifying the duration of the oscillation angle control signal to effectively eliminate said discontinuity within a selected range of the second signals or input angles.

In another embodiment, the discontinuity may be shifted in response to a previous vector transformation having an input angle in close proximity to the discontinuity such that a hysteresis response in the oscillation angle control signal is provided with respect to the input angle.

DESCRIPTION OF THE PREFERRED EMBODIMENTS

Figure 1:
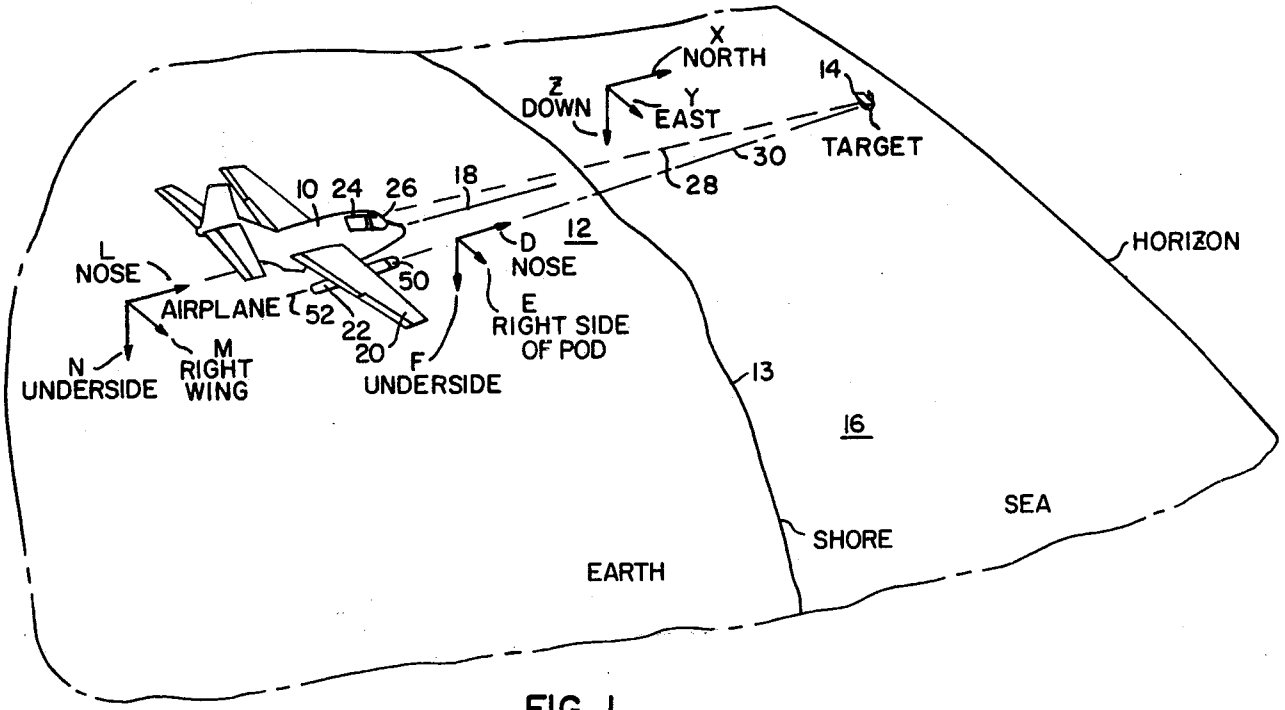
FIG. 1 is a view of an airplane flying above the earth with the airplane's ring sight and sensor pod directed at a target.

Referring now to the drawings, in FIG. 1 airplane 10 is shown flying over the earth 12 and pointed towards target 14 which is in the sea 16. The earth 12 is separated from the sea 16 by the shore 12. Airplane 10 has a reference line 18 which passes through the center of the fuselage from nose to tail. Pod 22 is attached to the airplane wing 20 such that the pod is immovable or stationary with respect to the wing 20 and reference line 18. In cockpit 24 of airplane 10 is located ringsight 26 (FIG. 3) which is in alignment with reference line 18. When the airplane 10 is directed towards target 14 a pilot is able to look through ringsight 26 (FIG. 3) which is likewise directed at target 14. Ringsight 26 is immovable or stationary with respect to the reference line 18. Line of sight 28 connecting ringsight 26 and target 14 shows that the airplane 10 is directed towards target 14. Pod 22 contains a sensor 50 (FIG. 3) which is directed at target 14 by electrical signals to a 2 axis gimbal platform. One example of a sensor directed at a target would be a mirror mounted on the two axis gimbal platform, each gimbal being driven by a torquing motor such that the line of sight 30 from target 14 would be reflected off the mirror 56 (FIG. 3) and into the sensor 50 (FIG. 3).

Figure 2:
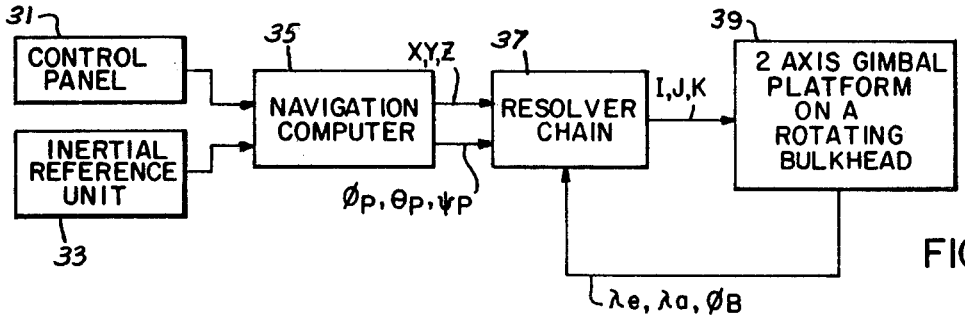
FIG. 2 is a blocking diagram of an arrangement of apparatus for directing a sensor towards a target.

FIG. 2 shows in block diagram the arrangement of apparatus for directing a sensor towards a target 14 (FIG. 1) from an airplane 10 (FIG. 1). Cockpit control panel 31 may include a series of switches which the pilot may set to insert the geographical position of a desired target. Alternatively the pilot may have a ringsight either movable or fixed with means for providing to the cockpit control panel the direction of the ringsight and a time reference switch to indicate when the ringsight is properly pointed at a desired target. The control panel electrically transfers this information to the navigation computer 35. The cockpit control panel 31 provides the navigation computer 35 with the initial conditions such as the geographic position of the target or the pointing direction to the target from the airplane 10, FIG. 1, and the time upon which this information is valid since the airplane is moving. Inertial reference unit 33 provides the navigation computer 35 with data pertaining to the motion of the airplane 10, FIG. 1, such as attitude, pitch, roll, velocity and acceleration information. The navigation computer 35 calculates the vector of unit magnitude or the line of sight angle to the target in geographic coordinates X, Y, Z, and calculates the angular orientation of airplane 10, FIG. 1, with respect to the geographic coordinates X, Y, Z. This information is calculated on a recurrent basis so that recent airplane 10, FIG. 1, motion is accounted for. The navigation computer 35 provides the information X, Y, Z and $\psi_p$, $\theta_p$, $\phi_p$, the heading, pitch, and roll angles to resolver chain 37 (see FIG. 5). The resolver chain 37 also accepts angular information from synchros attached to each axis of the two axis gimbal platform 39 such as $\lambda_e$, $\lambda_a$ and from the axis of the sensor bulkhead $\phi_B$. Resolver chain 37 which is shown in further detail in FIG. 5 converts the vector of unit magnitude or the line of sight angle in geographic coordinates X, Y, Z to the sensor 50 (FIG. 3) coordinates I, J. K. The resolver chain 37 provides I, J, K to the torquing motors on the two axis gimbal platform 39, which points a mirror 56, shown in FIG. 3, to the target 14 (FIG. 1), and to the torquing motor on the sensor bulkhead.

Figure 3:
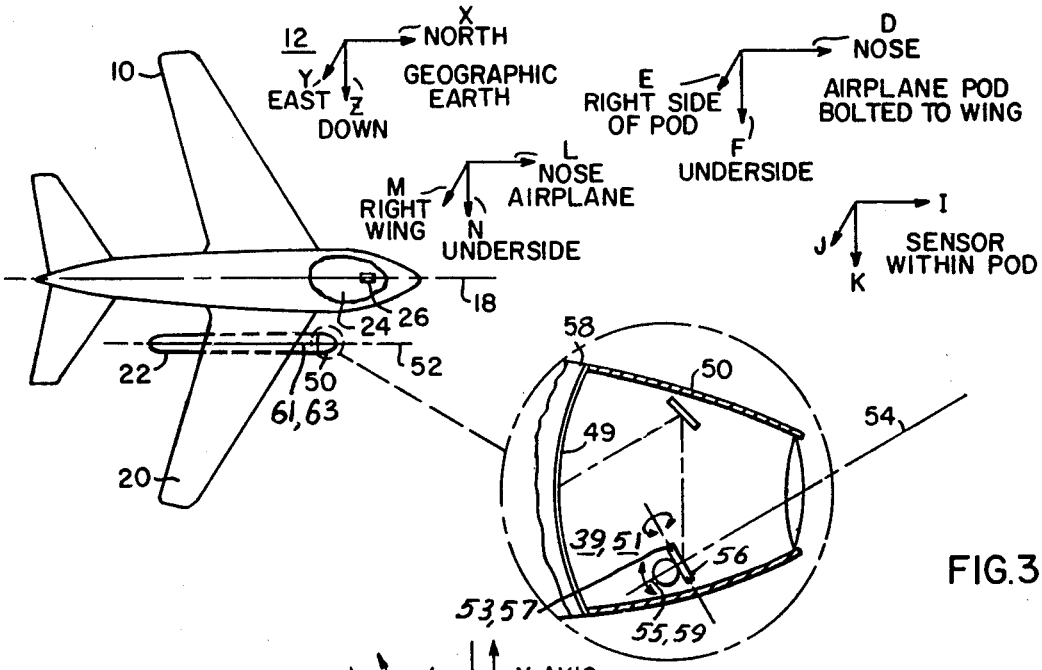
FIG. 3 shows several coordinate systems with reference to the earth, airplane, pod, and sensor.

FIG. 3 shows airplane 10 with reference line 18 in top view showing pod 22 under wing 20. Pod 22 has reference line 52 which passes through the center of pod 22 in the lenghtwise direction. The forward portion of pod 22 contains sensor 50 which has a reference line 54 which is orientated for example with a mirror 56. Mirror 56 may be mounted on a two axis gimbal platform 51 with torquing motors 53 and 55 and synchro angle transducers 57 and 49 to provide angles $\lambda_2$ and $\lambda_a$. Sensor 50 may be rotated about the axis of reference line 52 at the bulkhead 58 between the sensor 50 and the pod 22 by torquing motor 61. a synchro 63 is provided to indicate the angular rotation $\phi_B$ of the sensor bulkhead 58. Various coordinate systems such as geographic earth, airplane, airplane pod, and sensor have been used to facilitate the description of motion and direction with respect to each coordinate system. For example a pilot may move his finger in a circle orthogonal to the motion of airplane 10. The pilot's finger will trace out a circle with reference to the airplane coordinate system. With respect to the geographic earth coordinate system, the motion of the pilot's finger will trace out a helix or spiral such as the thread of a screw. In FIGS. 1 and 3, earth 12 is shown with geographic coordinates X pointing in the north direction, Z pointing in the downward direction in line with the earth's gravitational force, and Y pointing in the east direction. Coordinates for the airplane are shown as L which is in the direction of the reference line 18 pointing forward, N which points downward from the underside of the airplane, and M which is orthogonal to L and N and points out the right side of the airplane or out from the ring wing. Coordinates for the pod are shown as D which runs along the reference line 52 towards the nose of the pod 22, F which points downward from the pod position when the pod is attached to the wing 20. E is orthogonal to D and F and points out the right side of the pod 22 in the direction of the wing tip when the pod 22 is attached to the wing 20. The sensor 50 has a coordinate I pointed in the direction of reference line 54, coordinate K pointed downward and orthogonal with respect to reference line 54, and coordinate J orthogonal to I and K and pointed to the right side of reference line 54 when facing in the direction of I. The advantage of the four coordinate systems is that a particular motion or direction may be described with respect to one particular coordinate system. The motion or direction described relative to a coordinate system may be subsequently transformed or converted to motion or direction relative to another coordinate system with relative ease with a harmonic oscillator coordinate converter. The relationship of one coordinate system to another may be fixed such as by mechanical structure or it may be movable such as an airplane moving with respect to the earth or a two axis gimbal platform moving with respect to the airplane. The instant relationships as presented herein between coordinate systems are angular (as opposed to linear) and may be determined by various means such as an inertial reference unit, a synchro which detects the angular rotation of a shaft or by other physical measurements.

Figure 4:
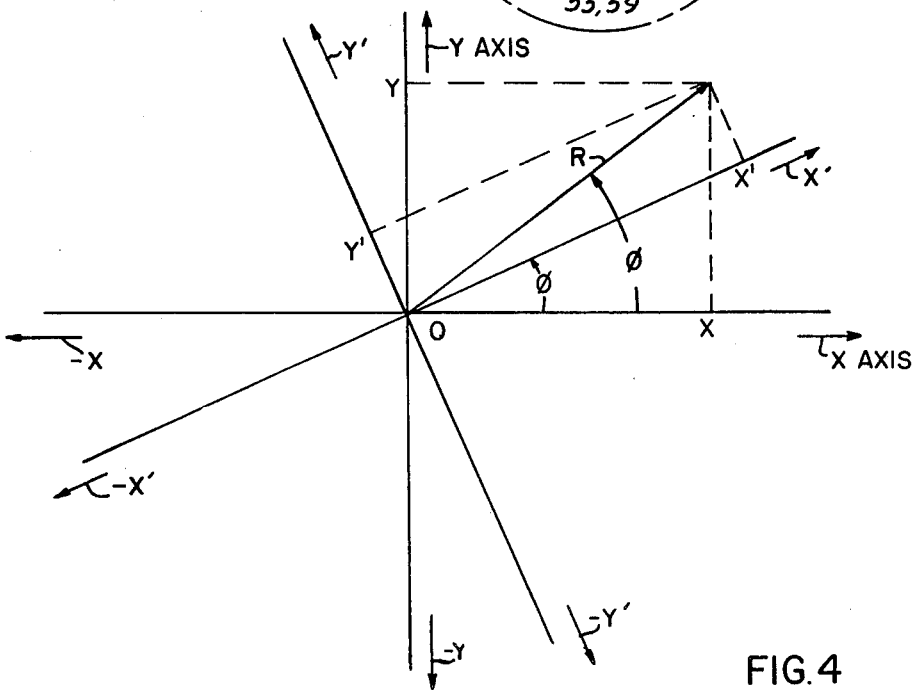
FIG. 4 is an illustration of a coordinate rotation through an angle $\theta$.

The rotation of a coordinate system in one direction may be alternately described as the rotation of the vector in the other direction by an equal amount. FIG. 4 shows the rotation of a vector through an angle $\theta$ which is equivalent to a coordinate rotation of an angle $\theta$ in the other direction. An example of coordinate rotation may be shown if the pod coordinates D, E, and F, were initially aligned with the sensor coordinates I, J, and K, respectively. Then if mirror 56 should move upwards, this would be the same as coordinates I and K rotating around the axis of coordinate J or E by an angle $\theta$. $\theta$ would be the pointing angle of the mirror compared to the initial direction, and $\theta$ would be the angle between coordinate I and coordinate D or coordinate K and coordinate F.

In FIG. 4, vector R represents the original vector at angle $\phi$ and having coordinate values Y and X where Y is the ordinate and X is the abscissa. Vector R after the coordinate system has been rotated through an angle $\phi$ has new coordinate values Y' and X'. The magnitude of vector R remains unchanged. If the angle of rotation of the coordinate system is known along with the original values Y and X, then the new coordinate values Y' and X' may be calculated as provided in Equations 1 and 2.

$$X' = X\cos\theta + Y\sin\theta \quad (1)$$

$$Y' = Y\cos\theta - X\sin\theta \quad (2)$$

The angle $\theta$ in FIG. 4 represents the measured angle of rotation of one coordinate system with respect to another. The measurement of one coordinate angle may be made by the means of a synchro connected to the axis of rotation in one coordinate system and referenced to another system. The synchro would provide an electrical signal indicative of the rotation. Alternately, the movement or rotation of a coordinate system with respect to another coordinate system may be measured by an inertial reference unit which would provide signals indicative of motion and of angular rotation.

Figure 5:
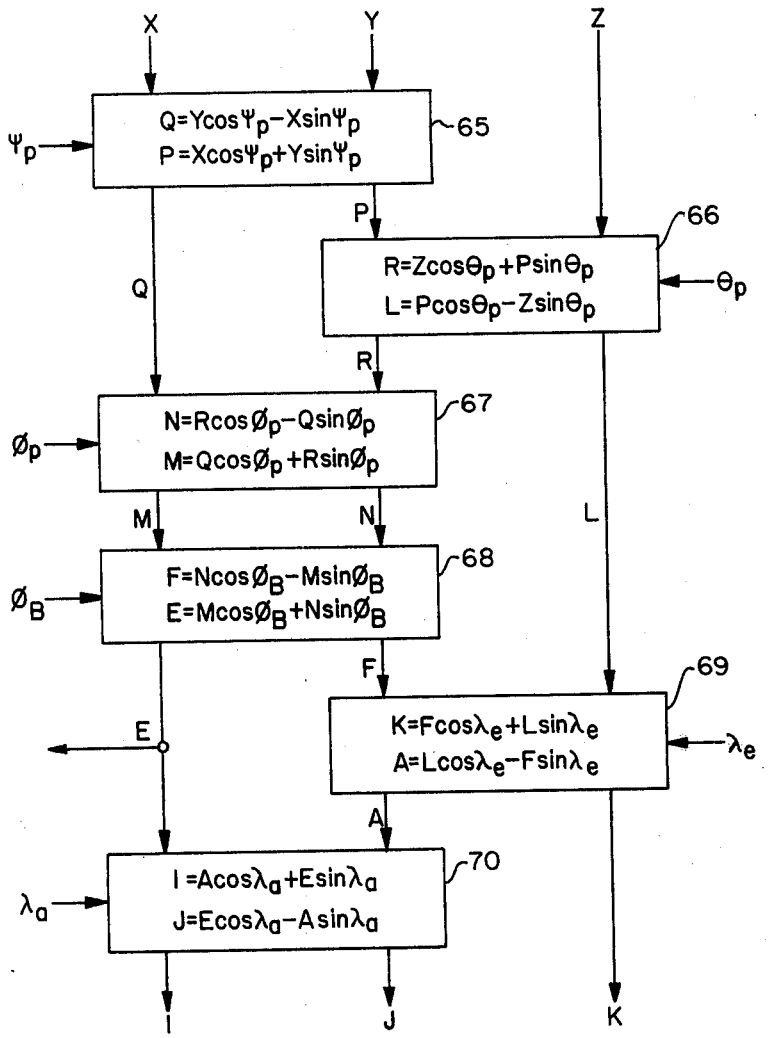
FIG. 5 illustrates the equations and sequence for a forward resolver chain.

FIG. 5 shows the mathematical sequence of a forward resolver chain such as that used in FIG. 2 for resolver chain 37. The input coordinate components X, Y and Z shown at the top of FIG. 5 represent the vector R of unit magnitude or a line of sight path to the target 14 from airplane 10 as shown in FIGS. 1 and 3. The equations in boxes 65 through 70 in FIG. 5 represent the mathematical steps of transforming a vector from the coordinates X, Y and Z to the coordinates I, J and K. $\psi_p$ represents the heading angle of the airplane. $\phi_p$ is a measure of the roll angle of the airplane. $\theta_p$ is the angle between coordinate Z and coordinate N or the pitch of the airplane. Coordinates D, E and F coincide with L, M, and N or are mechanically stationary and therefore no boresight angles need to be transformed between the airplane coordinate system and the airplane pod coordinate system in the resolver chain of FIG. 5. $\phi_B$ is the roll angle at sensor bulkhead 58 of the sensor 50. $\lambda_e$ is the elevation angle of mirror 56. $\lambda_a$ is the azimuth angle of mirror 56 as shown in FIG. 3.

The mathematical equations inside equation box 65 which transforms the coordinate components of R, X and Y, through the angle $\psi_p$ may be performed with a harmonic oscillator coordinate converter.

A typical harmonic oscillator coordinate converter has an internal parameter known as the oscillation angle control signal ($\omega t_x$) which is a function of the angle $\theta$ through which a vector R is to be rotated. The internal parameter, oscillation angle control signal, in a harmonic oscillator coordinate converter has a discontinuity or step function at $-\pi$, 0, $+\pi$ and $\pi 2$ radians as shown graphically in FIG. 6 where the ordinate represents the oscillation angle control signal and the abscissa represents the input angle $\theta$.

The harmonic oscillator is said to operate in one transformation mode for input angles on the left side of the oscillation angle control signal transition point and to operate in a second transformation mode for input angles on the right side of the oscillation angle control signal transition point.

Figure 6:
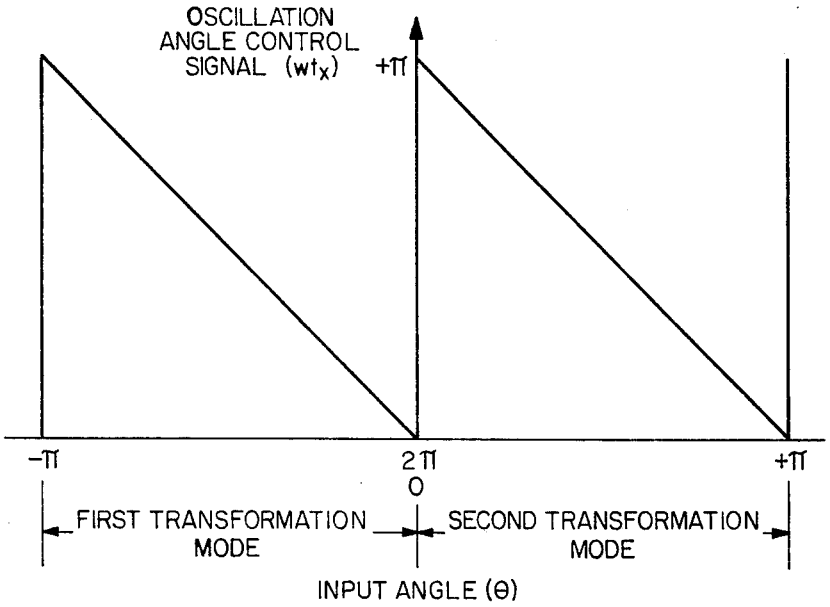
FIG. 6 is a graph showing the oscillation angle of a harmonic oscillator as a function of the input angle $\theta$.
Figure 7:
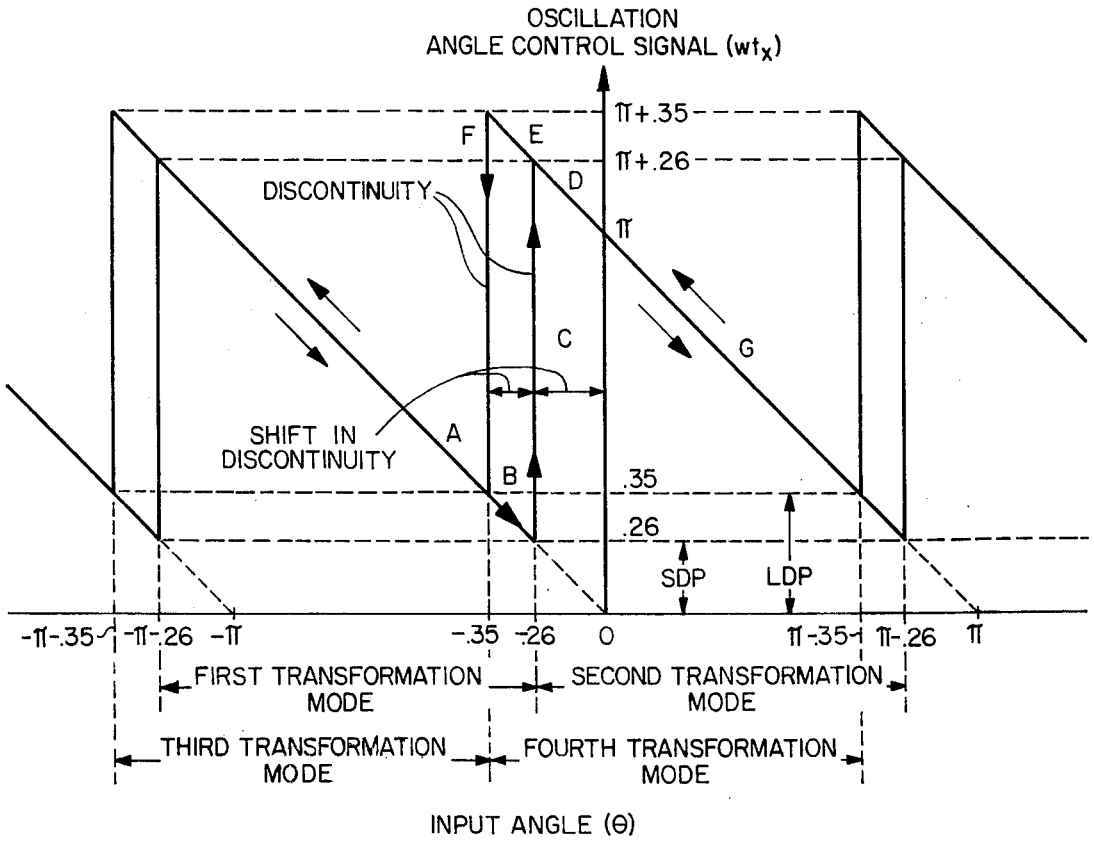
FIG. 7 is a graph showing the oscillation angle of a harmonic oscillator as a function of the input angle $\theta$ with the discontinuity in the oscillation angle shifted.

The input angle $\theta$ corresponds to the angle $\psi_p$ in equation box 65 for example. Recurrent coordinate transformation involve recurrent measurements of the input angle $\theta$ which may vary due to mechanical and electrical noise in addition to the functional variations such as heading changes due to airplane motion. If for example, the angle is zero radians, a slight increment of noise may cause the input angle $\theta$ to occur on one side and then the other side on a recurrent basis of the oscillation angle control signal discontinuity as shown in FIG. 6. In order to prevent an input angle with noise to occur on a recurrent basis across the oscillation angle control signal discontinuity or in the first and second transformation mode, the discontinuity may be shifted as shown in FIG. 7 by curve A, B, C, D and G. The ordinate in FIG. 7 represents the oscillation angle control signal and the abscissa represents the input angle $\theta$. In FIG. 7 the curve A, B, C, D and G shows a discontinuity at $-0.26$ radians. Curves A and B show the oscillation angle control signal on the left side of the transition point at curve C which operates the harmonic oscillator in a first transformation mode. Curves D and G show the oscillation angle control signal on the right side of the transition point at curve C which operates the harmonic oscillator in a second transformation mode. Input angles $\theta$ of 0 or $2\pi$ radians with a slight amount of noise added would result in the oscillation angle control signal being along curve D and G without the discontinuity as shown in FIG. 6 at 0 or $2\pi$ radians.

Alternatively, the oscillation angle control signal discontinuity may be shifted from at curve C to curve F with respect to the input angle $\theta$ to form a hysteresis effect so that an input angle $\theta$ occurring near a discontinuity of the oscillation angle control signal would have the discontinuity shifted away from the current input angle $\theta$ to prevent an input angle $\theta$ from occurring on either side of the discontinuity of the oscillation angle control signal. The hysteresis effect of the oscillation angle control signal with respect to the input angle $\theta$ is shown by curves A, B, C, D, E and G or by curve G, D, E, F, A and B.

Figure 8:
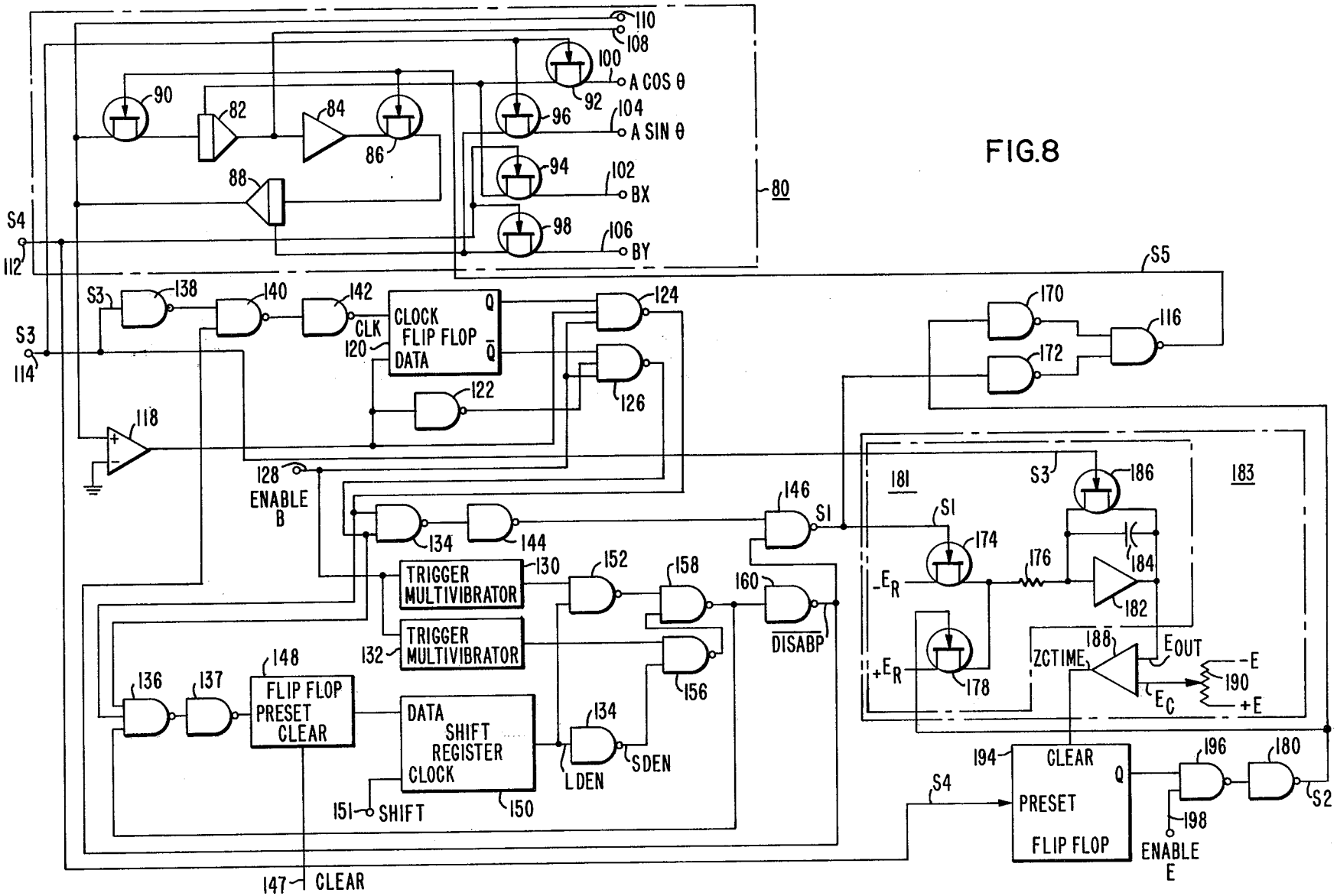
FIG. 8 is a schematic diagram of one embodiment of the invention.

Electronic apparatus for the transformation of a vector R from one coordinate system to another through an input angle $\theta$ is shown in FIG. 8. Means are also shown for shifting the discontinuity of an internal parameter of a harmonic oscillator coordinate converter with respect to an input angle $\theta$ such that an input angle $\theta$ is not transformed on both sides of the internal parameter discontinuity or in both first and second transformation modes due to small incremental variations of the input angle $\theta$ as for example due to noise. The internal parameter having the discontinuity is called the oscillation angle control signal or signal S5.

A harmonic oscillator 80 suitable for rotating vectors is shown in FIG. 8. The output of integrator 82 having a gain W is connected to the input of inverter 84 which inverts the output of integrator 82. The output of inverter 84 passes through switch 86 to integrator 88, also having a gain W. The output of integrator 88 is connected through switch 90 to the input of integrator 82. Switch 86 and switch 90 may for example be implemented with a field effect transistor (FET) including a voltage level driver in series with the gate which are commerically available. The control of switches 86 and 90 are connected to the output of NAND gate 116, the oscillation angle control signal or signal S5, which functions to open or close the switches at appropriate times with the appropriate voltage or control the oscillation of harmonic oscillator 80. Integrator 82 and 88 may each be constructed with an input resistor connected to an input of an operational amplifier and one side of a capacitor. The other side of the capacitor is connected to the output of an operational amplifier which is also the output of the integrator. With this circuit configuration the gain of the integrator W would equal 1/RC where R is the value of the resistor and C is the value of the capacitor. The gain W of the integrator would be in units of volts per second per volt. The inverter 84 may be implemented using an input resistor in series with an operational amplifier with a resistor connected in parallel across the operational amplifier. The input resistor would be the inverter input; and the output of the operational amplifier connected to the second resistor would be the inverter output. Initial conditions or initial voltages of the harmonic oscillator 80 are provided to the initial condition input of integrator 82 by switch 92 and switch 94. Initial conditions are placed on the initial condition input of integrator 88 by switch 96 and switch 98 which are connected to integrator 88. The initial conditions are placed on integrators 82 and 88 by placing a voltage across each capacitor of the respective integrator.

Terminals 100 is connected to switch 92 and to a voltage, $A\cos\theta$, where A is a constant and $\theta$ is the angle through which the vector R is to be rotated. Terminal 102 is connected to switch 94 and to a voltage BX where B is a constant and X is one of the coordinate components of vector R to be rotated. Terminal 104 is connected to switch 96 and to a voltage $A\sin\theta$, where A is a constant and $\theta$ is the angle through which vector R is to be rotated. Terminal 106 is connected to switch 98 and to a voltage, BY, where B is a constant and Y is the other coordinate component of vector R to be rotated. The output of integrator 82 is connected to terminal 108 which at the proper time, contains a voltage of one of the coordinate components of the rotated vector R. The output of integrator 88 is connected to terminal 110 which at the proper time, is a voltage which represents the other coordinate components of the rotated vector R. The control of switch 94 and switch 98 which may for example be the gate of a field effect transistor, is connected to terminal 112 which is connected to a signal S4 which at the proper time, opens and closes switch 94 and switch 98 with the appropriate voltage. The control of switch 92 and switch 96 is connected to terminal 114. Signal S3 is connected to terminal 114 which provides a voltage for opening and closing switch 92 and switch 96 at the proper times. The control of switch 86 and switch 90 is connected to the output of logic gate 116 which has a voltage signal S5 which controls the opening and closing of switch 86 and switch 90 at the proper times. The output of integrator 88 is also connected to the input of comparator 118. Comparator 118 has a second input connected to ground or zero volts. The output of integrator 88 has a voltage signal identified as $e_2(t)$ and the output of integrator 82 has a signal identified as $e_1(t)$.

The output of comparator 118 is connected to the data input of flip-flop 120, the input of inverter 122, and the input of NAND gate 124. The output signal of comparator 118 is identified as $ZVE_2$. The function of comparator 118 is to compare the input signal $e_2(t)$ with ground voltage and when $e_2(t)$ is less than ground to have an output voltage of a logic zero. Otherwise the output voltage would be a logic one. Hence when $e_2(t)$ has a voltage above ground and crosses zero to below ground, an output of a logic zero is observed at the output of comparator 118. The true output or $\bar{Q}$ of flip-flop 120 is connected to an input of NAND gate 124. The complementary output or Q of flip-flop 120 is connected to an input of NAND gate 126. Flip-flop 120 functions to store the output of comparator 118 at the proper times as determined by the clock input.

Terminal 128 is connected to the input of NAND gate 124, and to the input of NAND gate 126, to the input of multivibrator 130, and to the input of multivibrator 132. Terminal 128 is connected to signal ENABLE B which provides a timing signal for operation of the circuitry. The output of inverter 122 is connected to the input of NAND gate 126. The output of NAND gate 124 is connected to an input of NAND gate 134 and an input of NAND gate 136. The output of NAND gate 126 is connected to an input of NAND gate 134 and an input of NAND gate 136. The function of flip-flop 120 and inverter 122 and NAND gates 124, 126 and 134 is to provide a signal at the output of NAND gate 134 when ENABLE B is a logic one and when the output of comparator 118, $ZCe_2$, changes from a logic one to a logic zero or from a logic zero to a logic one. The output of NAND gate 134 is identified as signal ZC.

Terminal 114 is connected to the input of NAND gate 138. The output of NAND gate 138 is connected to an input of NAND gate 140. The output of NAND gate 140 is connected to the input of NAND gate 142. The output of NAND gate 142 is connected to the clock input of flip-flop 120.

The output of NAND gate 134 is connected to the input of NAND gate 144. The output of NAND gate 144 is connected to an input of NAND gate 146. The output of NAND gate 136 is connected to the input of NAND gate 137. The input of NAND gate 137 is connected to the preset input of flip-flop 148. Terminal 147 is connected to the clear input of flip-flop 148. The true output of flip-flop 148 (Q) is connected to the data input of shift register 150. Terminal 151 is connected to the clock input of shift register 150. The data output of shift register 150 is connected to an input of NAND gate 152 and the input of NAND gate 154. The output of NAND gate 154 is connected to an input of NAND gate 156. The output of multivibrator 132 is connected to an input of NAND gate 156. The output of multivibrator 130 is connected an input of NAND gate 152. The output of NAND gate 152 is connected to an input of NAND gate 158. The output of NAND gate 156 is connected to an input of NAND gate 158. The output of NAND gate 158 is connected to an input of NAND gate 136 and the input of NAND gate 160. The output of NAND gate 160 is connected to an input of NAND gate 140 and an input of NAND gate 146. The output of NAND gate 146 is connected to an input of NAND gate 172 and to the control of switch 174. Voltage reference $-E_R$ is connected to one side of switch 174. The other side of switch 174 is connected to resistor 176. One side of switch 178 is connected to the juncture of switch 174 and resistor 176. The other side of switch 178 is connected to voltage $+E_R$. The control of switch 178 is connected to the output of NAND gate 180. Switch 174 and switch 178 are operated in either the open or closed condition and may be field effect transistors. The other side of resistor 176 is connected to operational amplifier 182 and to one side of capacitor 184 and to one side of switch 186. The control of switch 186 is connected to terminal 114. Switch 186 is operated in the open and closed condition and may be a field effect transistor. The other side of switch 186 and the other side of capacitor 184 are connected to the output of operational amplifier 182 and to the input of comparator 188. Resistor 176, operational amplifier 182, capacitor 184, switch 186, switch 174, and switch 178 function together as integrator 181 where the gain K is equal to 1/RC volts per second per volt. The output of integrator 181 is signal $E_{out}$. One side of potentiometer 190 is connected to voltage +E and the other side of potentiometer 190 is connected to voltage −E. The tap on potentiometer 190 is connected to the input of comparator 188. The output of comparator 188 is connected to the clear input of flip-flop 194 and is identified as signal ZCTIME. The true output (Q) of flip-flop 194 is connected to the input of NAND gate 196. Terminal 198 is connected to an input of NAND gate 196. The preset input of flip-flop 194 is connected to terminal 112, signal S4. The output of NAND gate 196 is connected the input of to NAND gate 180. The output of NAND gate 180 is connected to the control of switch 178 and to the input of NAND gate 170.

A NAND gate is described as a logic gate where if any of the inputs are a logic zero then the output will be a logic one and only if all of the inputs are a logic one will the output be a logic zero. The voltages for a logic one may be from 3.5 to 5 volts and for a logic zero from 0 to 0.3 volts which is typical for commercially available TTL logic circuitry. All switches may include voltage drivers, not shown, to convert the control voltage swings of TTL logic to the necessary FET gate voltage swings to open and close the conduction of the switch.

The harmonic oscillator circuit 80 is well known in electronic engineering. It is also well known that this oscillator can be used as a coordinate converter. The equations of the output voltages of integrators 82 and 88 as a function of time and initial conditions may be arrived at by expressing the voltages as a differential equation and by finding the solutions of the differential equations by using LAPLACE Transforms. Equations 3 and 4 provide the solution for $e_1(t)$ and $e_2(t)$.

$$e_1(t) = e_1(0) \cos wt - e_2(0) \sin wt \quad (3)$$

$$e_2(t) = e_1(0) \sin wt + e_2(0) \cos wt \quad (4)$$

Figure 9:
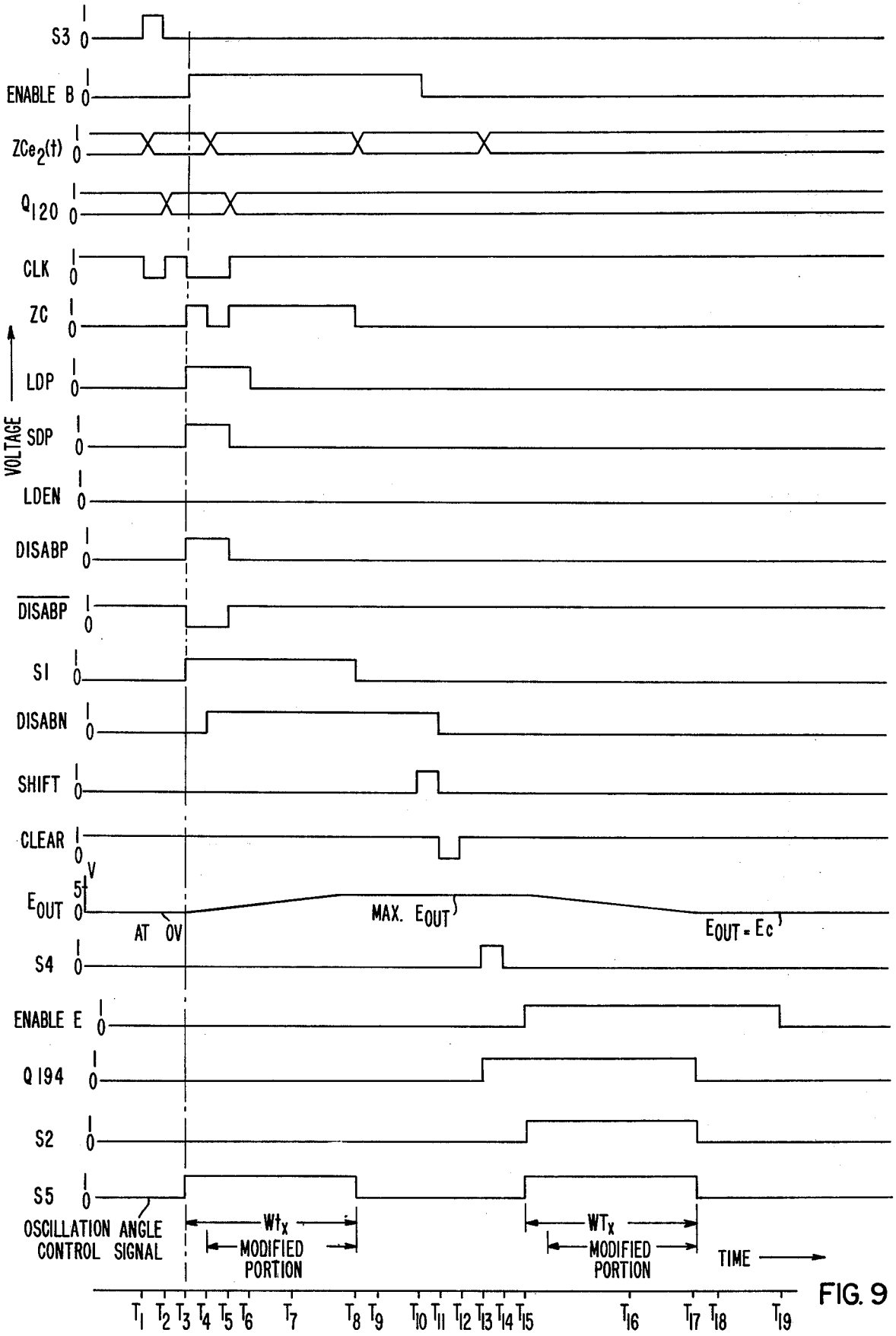
FIGS. 9 through 11 are a set of waveforms illustrating the operation of the embodiment shown in FIG. 8.
Figure 10:
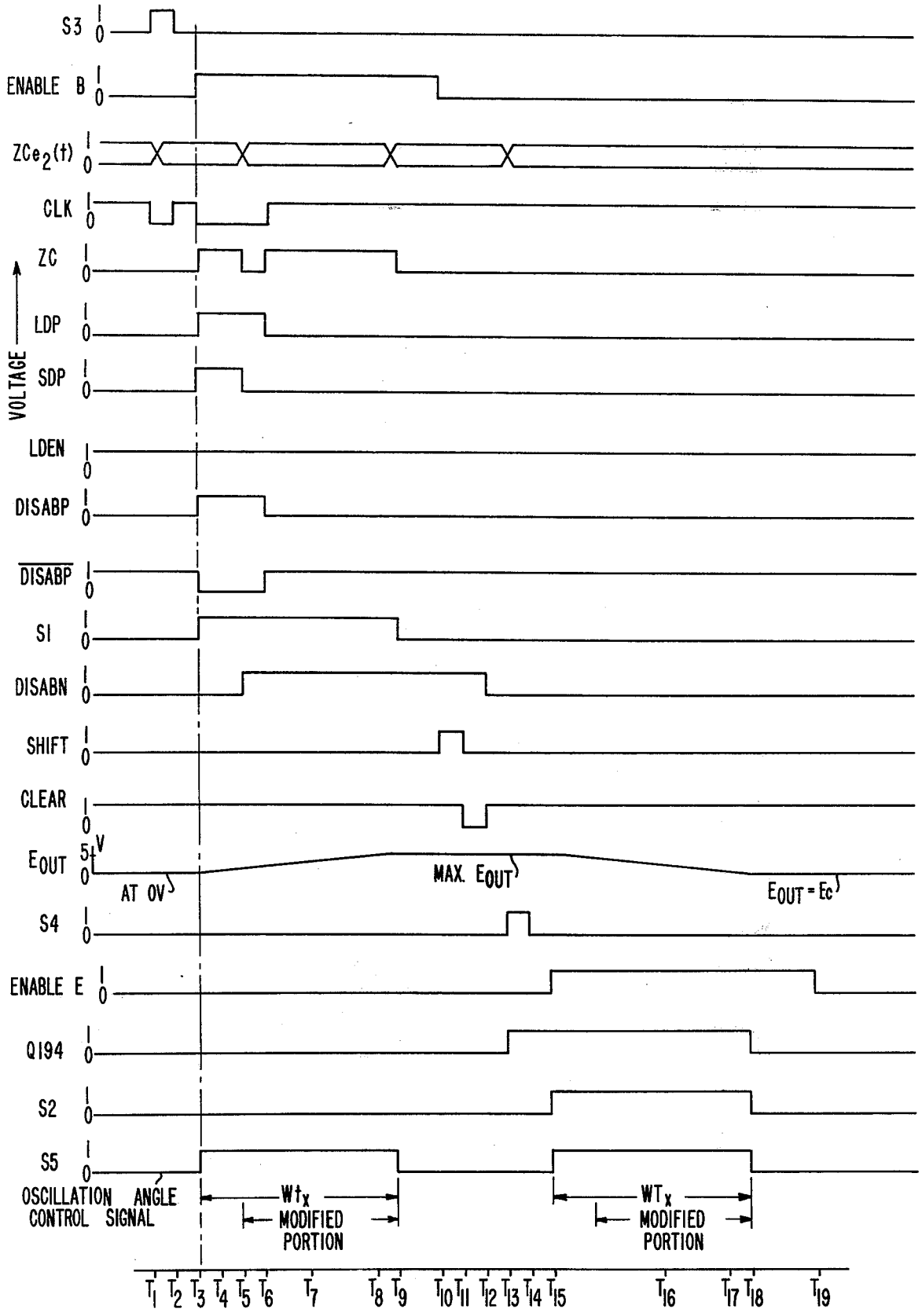
Figure 11:
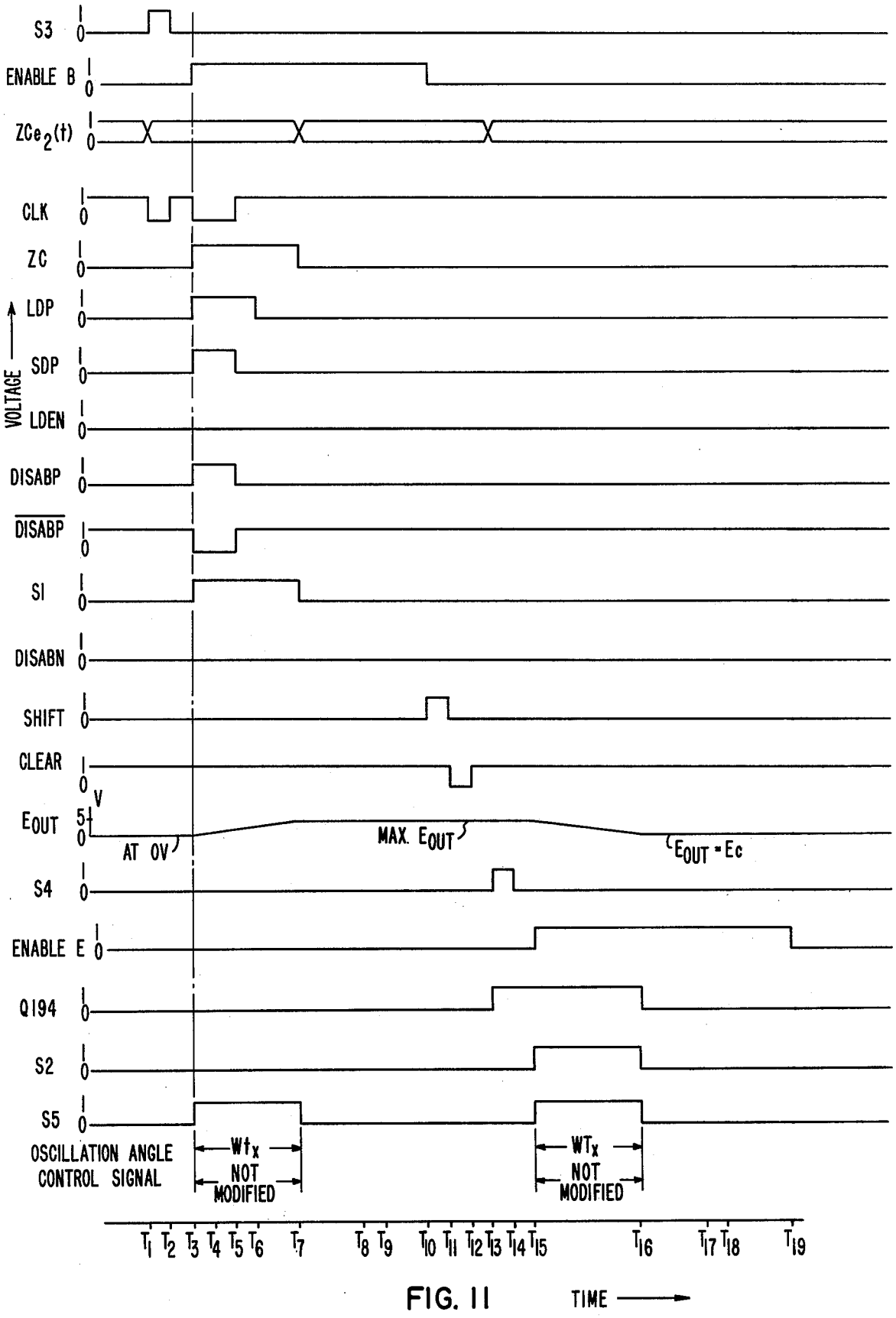

The operation of the system of the present invention as described in connection with FIG. 8 is also described with reference to FIGS. 9, 10 and 11 which show timing waveforms. Referring now to FIG. 9, between times T1 and T2, signal S3 at terminal 114 is a logic one which closes switch 92 and switch 96 and switch 186 which initializes the voltages in integrators 82, 88 and 181, respectively. Integrator 82 is initialized with a voltage on terminal 100 representative of $A\cos\theta$. Integrator 88 is initialized with a voltage on terminal 104 representative of $A\sin\theta$, and integrator 181 is initialized with zero volts across capacitor 184. $A\sin\theta$ and $A\cos\theta$ are DC voltages where A is a constant and $\theta$ is the measured sensor angle. Signal S3 on NAND gate 138 causes the output of NAND gate 142 to be a logic zero which is designated as signal CLK and is shown in FIGS. 9, 10 and 11. When signal CLK returns to a logic one at T2, the logic level of signal $ZCe_2$ present on the data input terminal of flip-flop 120 is stored in flip-flop 120 and is present on the output terminals Q120 and $\bar{Q}$120. Between T1 and T2, signal S4 is a logic zero and switches 94 and 98 are open. Signals ENABLE B and ENABLE E are connected to terminals 128 and 198 respectively. Between T1 and T3, signals ENABLE B and ENABLE E are a logic zero. Signals S1, S2 and S5 are set to a logic zero by ENABLE B and ENABLE E which in turn holds open switches 90, 86, 174 and 178. During this period $ZCe_2(t)$ may be either a logic one or a logic zero depending upon the initial conditions imposed on integrator 88 between T1 and T2. Signal $E_{out}$ of integrator 181 is zero volts since switch 186 was closed during T1 to T2 which completely discharged capacitor 184. With integrators 82 and 88 initialized to the proper voltages between T1 and T2 ($A\cos\theta$, $A\sin\theta$), the harmonic oscillator 80 is allowed to oscillate by closing switches 90 and 86 which is controlled by signal S5 at T3. S5 is a logic one when S1 is a logic one. The initialized voltages on the harmonic oscillator between T1 and T2 correspond to the input angle $\theta$ through which the coordinates of a vector R is to be rotated as shown in FIGS. 4, 6 and 7. The duration of S5 as a logic one during the period when ENABLE B is a logic one, is the oscillation angle of the harmonic oscillator. The oscillation angle as a function of the input angle $\theta$, is shown in FIG. 6 and FIG. 7. FIG. 7 shows the relationship of the oscillation angle to the input angle $\theta$ using the invention as embodied in FIG. 8.

When ENABLE B goes to a logic one at T3, and if signal $ZCe_2$ is a logic one, then the output of NAND gate 124 will be a logic zero which will cause the output of NAND gate 134 to be a logic one. If signal $ZCe_2$ is a logic zero, then the output of NAND gate 126 will be a logic zero causing the output of NAND gate 134 to be a logic one. Signal ZC will cause the output of NAND gate 144 to be a logic zero which causes the output of NAND gate 146 to be a logic one, which is signal S1. When signal S1 is a logic one, it causes the output of NAND gate 172 to be a logic zero and the output of NAND gate 116 or signal S5 to be a logic one. When signal S5 is a logic one, it closes switches 86 and 90 and thereby allows harmonic oscillator 80 to oscillate. Signal S1 closes switch 174 of integrator 181. The duration of oscillation of harmonic oscillator 80 during ENABLE B, the oscillation angle, is expressed as $Wt_x$ which is shown in FIGS. 9, 10 and 11 and 7.

Signal ENABLE B at T3 also triggers multivibrators 130 and 132 which causes an output signal of a logic one for a predetermined duration of time or a fixed pulse length whereupon the output will return to a logic zero. The signal output of multivibrator 130 is LDP and the signal output of multivibrator 132 is SDP. The time duration of signal LDP corresponds to an oscillation angle of harmonic oscillator 80 such as 0.35 radians which is shown in FIG. 7. The time duration of signal SDP, corresponds to a shorter oscillation angle of harmonic oscillator 80 than LDP such as 0.26 radians which is shown in FIG. 7.

If the output of shift register 150, signal LDEN is a logic zero, then the output of NAND gate 152 and NAND gate 154 are a logic one which will cause signal SDP from multivibrator 132 to be gated through NAND gate 156 and 158 generating signal DISABP which is a logic one and of the same time duration as signal SDP which is from time T3 to time T5. The output of NAND gate 160 is $\overline{\text{DISABP}}$. During the time that $\overline{\text{DISABP}}$ is a logic zero, the output of NAND gate 146 signal S1 is a logic one, and the output of NAND gate 142 signal CLK is a logic zero. Since signal S1 is held to a logic one, when signal SDP is a logic one by signal $\overline{\text{DISABP}}$, the harmonic oscillator 80 will oscillate through the oscillation angle 0.26 radians as shown in FIG. 7 even though signal $ZCe_2$ changes logic state at T4 as shown in FIG. 9. When signal SDP returns to a logic zero, signal $\overline{\text{DISABP}}$ will return to a logic one which in turn causes signal CLK to return to a logic one, which causes flip-flop 120 to store the logic state of signal $ZCe_2$ at T5. Since signal Q120 corresponds to signal $ZCe_2$ at T5, signal ZC will be a logic one until signal $ZCe_2$ changes logic state which occurs when $e_2(t)$ crosses zero volts at T8 in FIG. 9.

When signal ZC goes to a logic zero and signal $\overline{\text{DISABP}}$ is a logic one, the output of NAND gate 146, signal S1, will go to a logic zero which causes signal S5 to go to a logic zero, which will terminate the oscillation of harmonic oscillator 80. The duration of signal S5, $Wt_x$, is the oscillation angle of the harmonic oscillator 80 when LDEN is a logic zero, which is shown by curve A, B, C, D and G in FIG. 7 with the timing waveforms in FIGS. 9 and 11.

During the time that harmonic oscillator 80 oscillates, or when S1 and S5 are a logic one, switch 174 is closed causing integrator 181 to start integrating or charging. The output of integrator 181 is signal $E_{out}$ which is proportional to the time duration of signal S1 or to the oscillation angle, $Wt_x$. The voltage $E_{out}$ of integrator 181 is a voltage representation of the time that harmonic oscillator 80 was allowed to oscillate. When signal S1 goes to a logic zero, switch 174 is opened and integrator 181 stops integrating leaving the output of integrator 181 at the same voltage value as it had when it stopped integrating.

Signal S1 and S5 go to a logic zero at T8 when signal ZC goes to a logic zero, which is in response to signal $ZCe_2(t)$, which changes logic state when the output of integrator 88 signal $e_2(t)$ crosses zero volts and is detected by comparator 118. Signal $e_2(t)$ equals zero when $Wt_x$ plus $\theta$ equals $\pi$ or $2\pi$. The time required for signal $e_2(t)$ to cross zero is stored in integrator 181. $Wt_x$ may be expressed as shown in equations 5 and 6.

$$t_x = (\pi - \theta)/w \text{ For } -0.26 \leqq \theta \leqq \pi - 0.26 \quad (5)$$

$$t_x = (2\pi - \theta)/w \text{ For } \pi - 0.26 \leqq \theta \leqq 2\pi - 0.26 \quad (6)$$

Referring to FIG. 9, signal DISABP is a logic one from T3 to T5. If signal $ZCe_2$ changes state while signal DISABP is a logic one, the output of NAND gate 136 will go to a logic zero which will set the output of NAND gate 137 to a logic one which will preset flip-flop 148 to a logic one with an output signal DISABN. Signal SHIFT on terminal 151 occurring between T10 and T11, will cause the signal DISABN to be stored in shift register 150. Signal CLEAR on terminal 147, occurring between T11 and T12 of FIG. 9, clears flip-flop 148 causing the output signal DISABN to go to a logic zero.

If signal LDEN remains a logic zero during the time that ENABLE B is a logic one, then the oscillation angle control signal of the harmonic oscillator 80 as a function of input angle $\theta$ will be as shown in FIG. 7 along curve A, B, C, D and G. The step function in the oscillation angle control signal or transition point which occurred at an input angle $\theta$ of 0, $\pi$ or $2\pi$ has been shifted to occur at an input angle $\theta$ of $-0.26$ radians, $\pi - 0.26$ radians, or $2\pi - 0.26$ radians, as shown in FIG. 7.

In order to provide a hysteresis response in the oscillation angle control signal with respect to the input angle, signal LDEN is a logic one and causes signal LDP which has a longer duration or fixed pulse length than signal SDP to control signals DISABP and $\overline{\text{DISABP}}$. Referring now to FIG. 7, the hysteresis in the oscillation angle control signal is provided by adding curves E and F to curves A, B, C, D and G. In other words, successive coordinate transformations with an input angle $\theta$ approaching from the left in FIG. 7 towards zero and on to $\pi$ would follow along curve A, B, C, D and G. Once the transition point at curve C has been crossed from curve B to curve D, any decrease in the input angle $\theta$ (towards the left) would be along curve E instead of curves C and B. If the input angle $\theta$ would continue to decrease away from zero (towards the left), a second transition point at curve F from curve E to curve A would occur. If the input angle would again approach zero (towards the right), the oscillation angle control signal would follow along curve A, B, C, D and G. Signal LDP increases the oscillation angle control signal by $\pi$ radians to the value of the input angle where the transition from curve E to curve F would occur and a transition from curve F to curve A would occur, the transition point. FIG. 10 shows the waveform for the embodiment as shown in FIG. 8 where signal LDEN is a logic one and signal $ZCe_2(t)$ changes logic state during the time when signal LDP is a logic one. The oscillation angle control signal or the duration of S1 and S5 or the output voltage $E_{out}$ from T3 to T9 is shown. Generally, when LDEN is a logic one, the oscillation angle control signal would be along curve A, F, E, D or G shown in FIG. 7 dependent upon or as a function of the particular input angle $\theta$. Curve A shows the oscillation angle control signal on the left side of the transition point at curve F which operates the harmonic oscillator in a third transformation mode. Curves E, D, and G show the oscillation angle control signal on the right side of the transition point at curve F which operates the harmonic oscillator in a fourth transformation mode.

FIG. 11 shows the waveforms for the embodiment of the invention as shown in FIG. 8 for the case when signal LDEN is a logic zero and signal $ZCe_2(t)$ changes logic state after signal SDP. The oscillation angle control signal (S5) or the duration of signal S1 or the voltage of signal $E_{out}$ at time T7 is shown. Generally when LDEN is a logic zero, the oscillation angle would be along curve A, B, C, D and G.

The harmonic oscillator 80 can rotate one vector through an angle (plus a boresignt adjustment angle) at a time or during one transformation as shown in FIGS. 9, 10 and 11. Equation box 65 in FIG. 5 shows the equations for rotating a vector through an angle $\psi_p$. Equation box 66 shows the equations for rotating a vector through an angle $\theta_p$. Equation boxes 67, 68, 69 and 70 rotate the vector through an additional four angles, $\phi_p$, $\phi_B$, $\lambda_e$, and $\lambda_a$. The curves in FIGS. 9, 10 and 11 show the waveforms using the apparatus in FIG. 8 for rotating a vector through an angle according to the equations in any one equation box as shown in FIG. 5. The harmonic oscillator 80 may be used repeatedly to solve the equations in boxes 65 through 70 as shown in FIG. 5, one box at a time. Each equation box represents a resolver function, and the six equation boxes or six resolver functions cascaded in series represents a resolver chain as shown in FIG. 5. The resolver chain in FIG. 5 is repeatedly solved such as 30 times a second to provide the latest updated pointing vector R having coordinates I, J, K. According to the embodiment shown in FIG. 8, when harmonic oscillator 80 is rotating a vector R, the status or logic level of signal DISABN is stored in shift register 150 at T10. Signal DISABN is stored in shift register 150 until the harmonic oscillator 80 is again rotating a vector R through the same angle such as $\phi_p$ in FIG. 5. At the beginning of a vector rotation or before shift register 150 is read out to find out the value of DISABN when it was stored from the previous iteration. The signal DISABN readout is identified as signal LDEN and corresponds to the signal DISABN stored during the last vector rotation of a particular angle such as $\phi_p$. Thus, when signal DISABN is a logic one at T10 for a particular equation box or resolver function, shift register 150 stores the logic one at T10 until the harmonic oscillator 80 is again rotating a vector with respect to a particular equation box and associated angle as shown in FIG. 5. Then, at T1 or before, when solving a particular equation box DISABN is provided as signal LDEN. For six equation boxes, a 6 bit shift register is needed to store six signal DISABN's.

The oscillation angle control signal as shown in FIG. 7 is represented by the output of integrator 181 by the signal $E_{out}$. $E_{out}$ is expressed by Equations 7 and 8 where K equals 1/RC, where R is the value of the resistor 176 and C is a value of the capacitor 184.

$$E_{out} = KE_R t_x = (KE_R/w)(\pi - \theta) \text{ For } -0.26 \leqq \theta \leqq \pi - 0.26 \quad (7)$$

$$E_{out} = (KE_R/w)(2\pi - \theta) \text{ For } \pi - 0.26 \leqq \theta\ 2\pi - 0.26 \quad (8)$$

After signal ENABLE B goes to a logic zero at T10 and after the CLEAR signal at T12, then at T13 signal S4 will go from a logic zero to a logic one and stay at a logic one until T14, when signal S4 goes back to a logic zero. Signal S4 closes switch 94 and switch 98 and allows the voltage on terminals 102 and 106 to be placed on integrators 82 and 88 respectively. The voltage on terminal 102 is BX and the voltage on terminal 106 is BY. BX and BY are voltages proportional to the orthogonal component (X, Y) of a vector that is to be transformed through the angle such as $\theta$ and a small correction boresight angle $\Delta\theta$. Integrators 82 and 88 are initialized with voltages BX and BY while the harmonic oscillator loop is held open by switch 90 and switch 86 which is controlled by signal S5. S4 is a logic one for a sufficient amount of time to allow integrators 82 and 88 to be fully initialized with voltages BX and BY respectively. S4, during T13 to T14, presets flip-flop 194 to a logic one. During signal S4, signal $ZCe_2(t)$ may change logic state due to the initial voltage placed on integrator 88. Since signal ENABLE B remains a logic zero after T10, the signal $ZCe_2(t)$ has no effect on the subsequent operation of the harmonic oscillator 80 because other signals are in control after T10 and signal S1 remains a logic zero.

At T15, ENABLE E goes to a logic one. NAND gate 196 with both inputs set to a logic one has a zero output which causes the output of NAND gate 180 to be a logic one which is signal S2. Signal S2 causes the output of NAND gate 170 to be a logic zero which causes the output of NAND gate 116 to be a logic one which is signal S5. Signal S5 closes switches 90 and 86 which starts the harmonic oscillator 80 to oscillate. Signal S2 also closes switch 178 which connects the input of integrator 181 to a positive reference voltage $+E_R$. With a positive input reference voltage the output voltage of integrator 181 tends to discharge with the rate of 1/RC, where R is the resistor value 176 and C is the capacitor value of capacitor 184.

The harmonic oscillator 80 or loop will continue to oscillate until signal S5 goes to a logic zero, which will occur when the signal S2 goes to a logic zero. While logic signal S2 is a logic one, the output of integrator 181 is continually decreasing and is compared by comparator 188. The other input of the comparator 188 is connected to a voltage, $E_C$, representative of the $\Delta\theta$ or boresight correction angle. If there is no boresight correction angle or $\Delta\theta$ is zero, then the input would be zero volts. The comparator 188 switches to a logic zero output when the output voltage of integrator 181, $E_{out}$ becomes slightly less than the voltage $E_C$. $E_C$ is the voltage on the tap of potentiometer 190. When comparator 188 switches to a logic zero, flip-flop 194 is cleared which forces signal Q194 to a logic zero, which in turn causes signal S2 to go to a logic zero at time T17 in FIG. 9. It is understood that there is some delay between signal Q194, signal S2, and signal S5 due to signal propagation delay time through the logic circuits.

Signal S2 at time T17 causes signal S5 to go to a logic zero which opens up switches 90 and 86. The output voltages of integrator 82, $e_1$(i t) and of integrator 88, $e_2(t)$ are voltages proportional to the orthogonal components (X″, Y″) of a vector R that has been transformed through the angle such as $\theta$ plus $\Delta\theta$.

The period that the harmonic oscillator 80 oscillates with initial conditions BX and BY on integrators 82 and 88 which occurs from time T15 to time T17 is known as $WT_x$ as shown in FIG. 9. Signal ENABLE E remains a logic one until time T19 which is after time T17. $WT_x$ is variable over a period of time due to the variation in the angle $\theta$ and $\Delta\theta$ for each particular vector transformation of the vector R. If $\Delta\theta$ is 0, then $Wt_x = WT_x$.

If the voltage $E_C$ on an input of comparator 188 is chosen to equal $KE_R\,\theta/w$, then the duration $T_x$ of the rotation time of the harmonic oscillator 80 is shown in Equation 9.

$$T_x = 1/KE_R\{E_{out} - (KE_R\,\Delta\theta)/w\} \quad (9)$$

Substitution of Equation 7 into Equation 9 yields Equation 10.

$$WT_x = \pi - \theta - \Delta\theta \quad (10)$$

Substitution of Equation 8 into Equation 9 yields Equation 11.

$$WT_x = 2\pi - \theta - \Delta\theta \quad (11)$$

Since at the time of rotation of the coordinate vectors, $e_1(0)$ equals BX and $e_2(0)$ equals BY, substitution of Equation 10 into Equations 3 and 4 yields Equations 12 and 13 which are the desired equations where X″ equals $-e_1/B$ and Y″ equals $-e_2/B$.

$$X'' = -e_1/B = X\cos(\theta + \Delta\theta) + Y\sin(\theta + \Delta\theta) \quad (12)$$

$$Y'' = -e_2/B = Y\cos(\theta + \Delta\theta) - X\sin(\theta + \Delta\theta) \quad (13)$$

Substitution of Equation 11 into Equations 3 and 4 yields Equations 12 and 13 except the polarity of $e_1/B$ and $e_2/B$ is positive. Therefore, $X''$ equals $e_1/B$ and $Y''$ equals $e_2/B$.

In the embodiment described in FIG. 8, a harmonic oscillator is combined with additional analog and digital circuitry to transform the coordinates of vectors through an angle such as $\theta$. A transition point or discontinuity in the oscillation angle control signal is shifted with respect to the input angle so that the discontinuity occurs at a predetermined angle where error effects due to the discontinuity are inconsequential. The shift was provided by extending the oscillation angle control by radians for input angles on one side of the transition point. The discontinuity may also be shifted in response to a previous vector transformation having an angle such as $\theta$ in close proximity to the discontinuity to provide a hysteresis response in the oscillation angle control signal with respect to the input angle.

The oscillation angle control signal is determined during the first portion of a vector rotation or during signal ENABLE B when the angle through which the coordinates of a vector are to be rotated is inserted into the harmonic oscillator loop and the loop is oscillated. The second or last portion of a vector rotation is during ENABLE E when the coordinates of a vector to be rotated are inserted into the loop and the loop is oscillated according to the oscillation angle control signal arrived at during the first portion of the vector rotation. A boresight correction angle if any due to misalignment is made by adjusting the oscillation angle control signal during ENABLE E.

We claim as our invention:

1. Electronic apparatus for transforming the coordinates of at least one vector through an input angle that is a measure of rotation of a first orthogonal coordinate system relative to a second orthogonal coordinate system about a common coordinate axis comprising:

first means for generating a first signal representative of said vector;

second means for generating a second signal representative of said input angle;

third means for generating an oscillation angle control signal having a transition point wherein an incremental change in said second signal at a first predetermined value causes a discontinuity in the duration of said oscillation angle control signal;

coordinate converter means responsive to said oscillation angle control signal for transforming said first signal in accordance with said second signal; and fourth means for modifying the duration of said oscillation angle control signal to effectively eliminate said discontinuity within a selected range of said second signals.

2. Electronic apparatus of claim 1 wherein said coordinate converter means includes a harmonic oscillator which includes a first and second integrator, each having an input and an output, connected in a loop, fifth means for opening and closing said loop, and sixth means for initializing said first and second integrators.

3. Electronic apparatus of claim 2 wherein said third means includes seventh means for controlling said fifth means, eighth means for detecting the output of said first integrator and providing an output signal and ninth means for reproducing the duration of said oscillation angle control signal.

4. Electronic apparatus of claim 3 wherein said fourth means includes tenth means for controlling said third means to provide an oscillation angle control signal of at least a first pulse duration.

5. Electronic apparatus of claim 4 wherein said fourth means includes eleventh means for controlling said third means to provide an oscillation angle control signal of at least a second pulse duration;

twelfth means for controlling said eleventh means to enable said eleventh means to control the minimum duration of said oscillation angle control signal from said first pulse duration to said second pulse duration.

6. Electronic apparatus of claim 5 wherein said twelfth means includes thirteenth means for storing a signal indicative of an output of said eighth means during said minimum pulse duration of said oscillation angle control signal during a prior transformation.

7. Electronic apparatus of claim 6 wherein said twelfth means includes fourteenth means for reading out said stored signal in said thirteenth means prior to the oscillation angle control signal during a current transformation.

8. Electronic apparatus of claim 1 wherein said fourth means includes fifteenth means for extending the oscillation angle control signal by an additional $\pi$ radians where $n$ is an integer.

9. Electronic apparatus of claim 3 wherein said eighth means includes means for detecting the change in output of said first integrator from a positive voltage to a negative voltage and from a negative voltage to a positive voltage and generating an output signal indicative of said change in output of said first integrator.

10. Electronic apparatus for transforming the coordinates of at least one vector through an input angle that is a measure of rotation of a first orthogonal coordinate system relative to a second orthogonal coordinate system about a common coordinate axis comprising:

first means for generating a first signal representative of said vector;

second means for generating a second signal representative of said input angle;

third means for generating an oscillation angle control signal having a transition point wherein an incremental change in said second signal at a first predetermined value causes a discontinuity in the duration of said oscillation angle control signal;

coordinate converter means responsive to said oscillation angle control signal for transforming the coordinates of said vector through said input angle;

fourth means for modifying the duration of said oscillation angle control signal to shift said transition point from said first predetermined value to a second predetermined value whereby a plurality of vectors may be transformed having input angles on either side of said first predetermined value without said step function thereby reducing transformation error.

11. Electronic apparatus for pointing a sensor where first signals indicative of a pointing direction are successively generated in a first orthogonal coordinate system and are successively transformed to a second orthogonal coordinate system having a common coordinate axis and where said first and second coordinate systems rotate about said common coordinate axis with respect to each other defining an input angle and where said input angle is measured successively to generate second signals indicative of the angular relationship between said first and second coordinate system which may include signal fluctuations due to the motion of said coordinate systems, measurement error and noise comprising:

first means for generating said first signals;

second means for generating said second signals;

third means governed by said second signals for transforming said first signals from said first coordinate system to said second coordinate system;

said third means including a plurality of transformation modes dependent upon the value of said second signals;

fourth means to generate a third signal to select the transformation mode dependent upon the value of said second signal during the present and last past transformation;

whereby said second signals including said signal fluctuations are transformed by said third means utilizing one transformation mode reducing transformation error which would arise from utilizing alternate transformation modes.

* * * * *